US007325552B1

(12) United States Patent
Wilkie

(10) Patent No.: US 7,325,552 B1
(45) Date of Patent: Feb. 5, 2008

(54) HAIR CURLING DEVICE

(76) Inventor: Ruby Wilkie, 2525 Ohio Ave., Youngstown, OH (US) 44504

( * ) Notice: Subject to any disclaimer, the term of this patent is extended or adjusted under 35 U.S.C. 154(b) by 2 days.

(21) Appl. No.: 11/484,311

(22) Filed: Jul. 12, 2006

(51) Int. Cl.
*A45D 2/08* (2006.01)

(52) U.S. Cl. ..... 132/250; 132/248; 132/268

(58) Field of Classification Search ..... 132/245–254, 132/262, 267; D28/37
See application file for complete search history.

(56) References Cited

U.S. PATENT DOCUMENTS

| | | | | |
|---|---|---|---|---|
| 720,726 | A * | 2/1903 | McCarthy | 132/248 |
| 731,861 | A * | 6/1903 | Connell | 132/248 |
| 2,847,015 | A * | 8/1958 | Davis | 132/250 |
| 3,025,862 | A | 3/1962 | Insana | |
| 3,136,415 | A | 6/1964 | Sandstrom | |
| 3,530,369 | A | 9/1970 | Thompson | |
| 3,960,156 | A | 6/1976 | Thompson | |
| 4,211,245 | A * | 7/1980 | Coppola et al. | 132/268 |
| 5,215,107 | A * | 6/1993 | Van Divner | 132/248 |

* cited by examiner

*Primary Examiner*—Robyn Doan
*Assistant Examiner*—Rachel A. Running
(74) *Attorney, Agent, or Firm*—Harpman & Harpman

(57) ABSTRACT

A hair curling device as disclosed which is comprised of a contoured elongated cylindrical body member on which a spiral groove is formed. The spiral groove has a progressively decreasing diameter towards its longitudinal center with multiple notched raised spiral ridges. An elastic band and retainer plug extend between said respective free ends resiliently engaging and restraining strands of hair would within the spiral groove and registerably received within the notch raised spiral ridges in a progressive manner.

4 Claims, 2 Drawing Sheets

HAIR CURLING DEVICE

BACKGROUND OF THE INVENTION

1. Technical Field

This device relates to hair curling and waving devices that are adapted to have human hair wrapped around to impart a curl thereto. Devices of this type use a spiral or helical groove on a relatively small diameter shaft to impart a tight spring-like configuration to the hair.

2. Description of Prior Art

Prior art devices of this type have relied on a variety of different curler body configurations onto which multiple strands of human hair are wrapped and then secured with a cord or clip to hold the hair for a pre-determined setting and drying time to impart the desired curl configuration within the hair.

Examples of smooth shafted hair curler bodies can be seen in U.S. Pat. Nos. 3,960,156, 3,530,369, and 3,025,862.

Prior art patents have utilized spiral and/or helical grooves within can be seen in U.S. Pat. Nos. 4,211,245 and 3,136,415.

In U.S. Pat. No. 3,960,156 a quick hair end wrap for permanent waves can be seen having a hollow curler body with a smooth outer surface. A sheet of film is wrapped around the hair as it is wrapped around the curling body.

In U.S. Pat. No. 3,530,363 a hair waving device is disclosed similar to that of the U.S. patent ending in 156.

In U.S. Pat. No. 3,025,862 another variation on the smooth curler body configuration is illustrated.

In U.S. Pat. No. 4,211,245 a hair waving device is shown having an elongated cylinder body of an equal diameter on which is formed a spiral hair receiving groove.

Finally, in U.S. Pat. No. 3,186,415 a hair curler with selectively engageable fastening means is disclosed wherein a curler has a tapered elongated body with a pair of leg members that define a split curler body member that begins inwardly of its distal end.

SUMMARY OF THE INVENTION

A contoured hair curler for use in specialized curling applications that require numerous tight spirals of hair. The hair curler defines an elongated contoured cylindrical body member with a spiral groove in its surface. The transverse dimension of the spiral remains constant from its respective ends importing a corresponding curl diameter configuration to the hair. An elastic retaining cord holds the hair within the respective grooves by registerably engaging raised spiral ridges in a spiral pattern over the length of the curler.

DETAILED DESCRIPTION OF THE INVENTION

Figure 1:
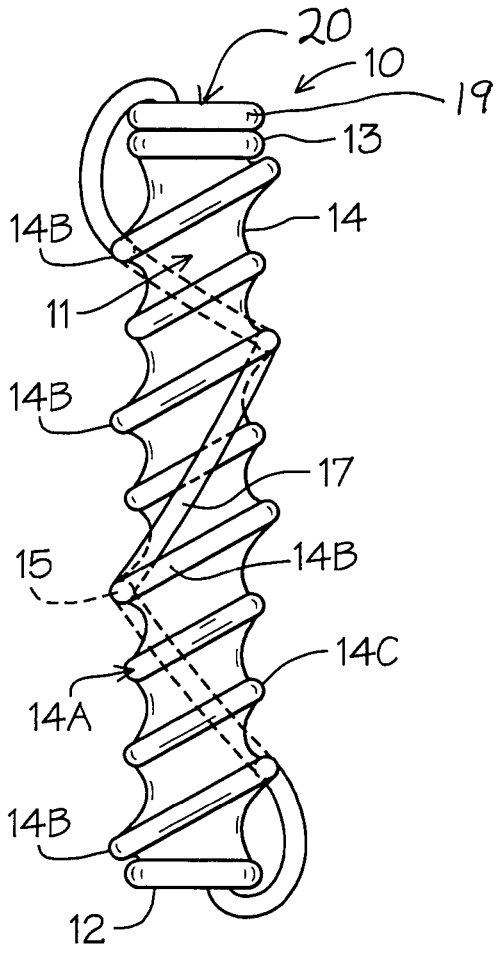
FIG. 1 is a front plan view of the hair curler of the invention in closed position.
Figure 2:
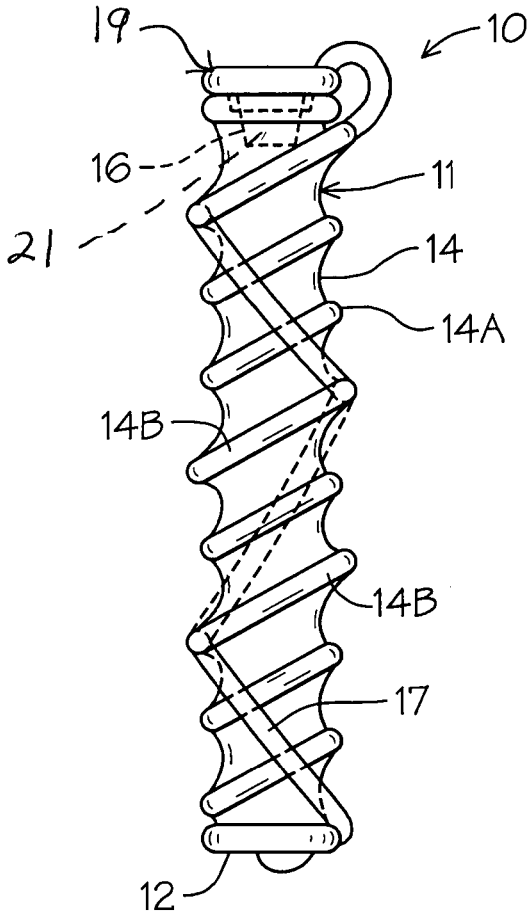
FIG. 2 is a rear plan view of the hair curler of the invention.
Figure 3:
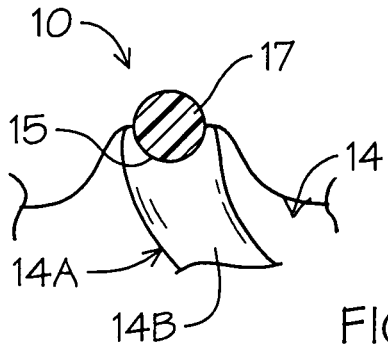
FIG. 3 is a partial section view thereof.

Referring to FIGS. 1-3 of the drawings, a hair curler 10 can be seen defining a generally cylindrical body member 11 having a proximal end 13 and a free end 12. A spiral groove 14 is formed in the side surface of the body member 10 and extends the entire length of same from the proximal end 12 to the free end 13.

The groove 14 finds a raised spiral ridge 14A therebetween that extends the length of the body member 11. The spiral ridge 14A is of a variable cross dimensional characteristic having an increase at 14B and a decrease at 14C transverse dimension as it travels the length of the body member 11. The plurality of band registration notches 15 are formed within the ridge 14A that corresponds with increasing dimensioned areas 14B.

In the proximal end 13 of the body member 11, a conical recess 16 is formed as best seen in FIG. 2 of the drawings.

An elongated elastic cord 17 extends from and is secured to the free end 12 of the body member 11 at 18, best seen in FIGS. 1 and 2 of the drawings. A retainer plug 19 is secured to the free end of said cord 17 and has a cylindrical base 20 with a conical portion 21 extending therefrom. The elastic cord 17 is of a length at rest that is less than that of said cylindrical body member 11 so that during use, the cord 17 must be stretched longitudinally for effective engagement of the attached plug 19 within the recess 16 as seen in FIG. 1 of the drawings.

The cord 17, during use, is engaged into the cord registration notches 15 on the spiral ridge 14B in a spiral pattern as it extends the length of the body member 11.

Figure 4:
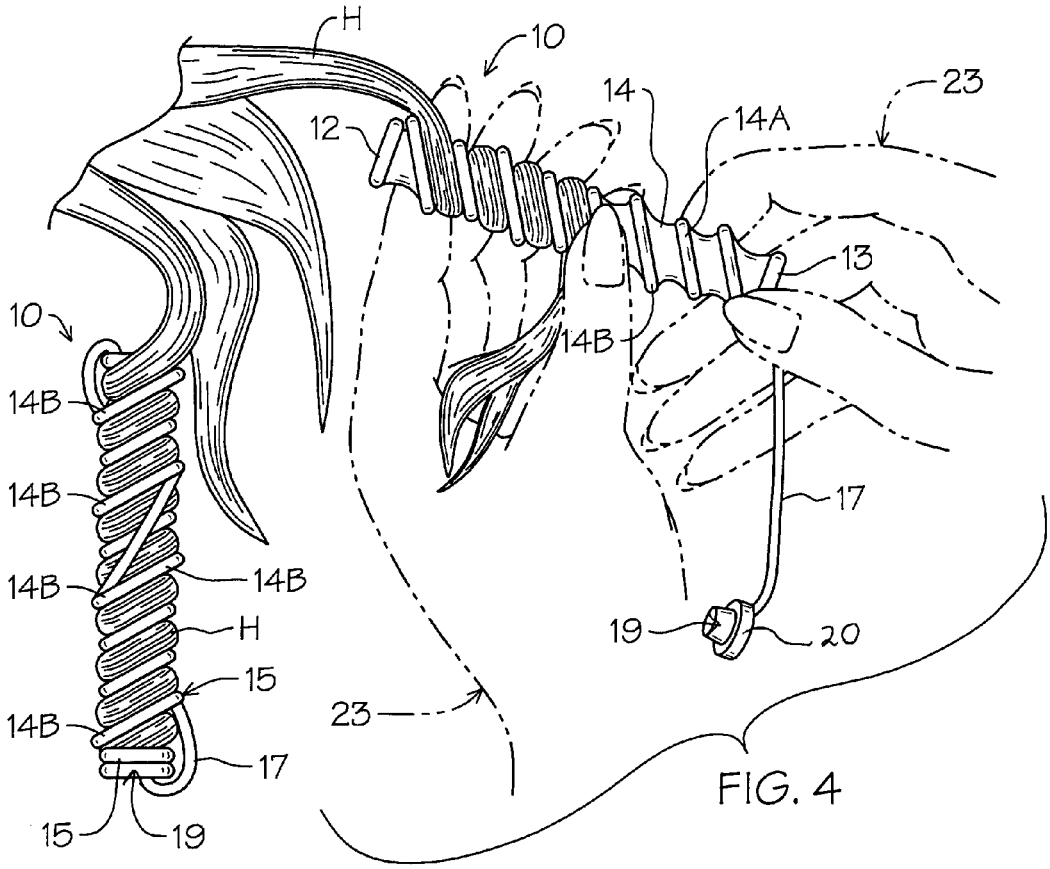
FIG. 4 is a pictorial view showing a number of hair curling devices of the invention in use.

Referring now to FIG. 4 of the drawings, the hair curler 10 of the invention can be seen in use wherein a wrapped curler 10 is shown wherein human hair H has been wrapped within the spiral groove 14 and secured by the spirally positioned and registerably secured elastic cord 17 as hereinbefore described.

FIG. 4 also shows the wrapping in progress wherein the hair H is being positioned within the groove 14 by the user's hands 23 and the elastic cord 17 has yet to be registerably engaged in the corresponding notches 15 and associated plug 19.

It will be so noted that by combining the positional registration of the elastic cord 17 into the registration notches 15 which are in longitudinally spaced relation to one another in the radial spiral ridge 14A that corresponding areas of increased dimensional characteristics that the hair H so wrapped will be maintained therewithin and so formed spiral groove 14 as previously described.

It will be apparent to those skilled in the art that various changes and modifications may be made thereto without departing from the spirit of the invention.

I claim:

1. A hair curling device comprising in combination, a contoured cylindrical body member, having a proximal end and a free end, said body member having an engagement portion and a terminal portion, a continuous spiral groove formed within the surface of said cylindrical body member, a continuous spiral ridge adjacent to said spiral groove, registration notches within said spiral ridge wherein the registration notches of said spiral ridge area in which said area is of increasing annular dimension, a resilient cord extending from said free end of said cylindrical body and registerable in said registration notches, a plug secured to the free end of said resilient cord, means for removably securing said plug in said proximal end of said cylindrical body.

2. The hair curler device set forth in claim 1 wherein said registration notches are positioned in longitudinally spaced spiral relation to one another.

3. The hair curler device set forth in claim 1 wherein said means for removably securing said plug in said proximal end of said cylindrical body member comprises, a recess within said proximal end of said cylindrical body, said recess being conical and of a dimension less than that of the cylindrical body member.

4. The hair curler device set forth in claim 1 wherein said cylindrical body member is of a known length that rests less than that of said cylindrical body.

* * * * *